US006536255B2

(12) United States Patent
Kraft

(10) Patent No.: US 6,536,255 B2
(45) **Date of Patent: *Mar. 25, 2003**

(54) MULTIVOID HEAT EXCHANGER TUBING WITH ULTRA SMALL VOIDS AND METHOD FOR MAKING THE TUBING

(75) Inventor: Frank F. Kraft, Adrian, MI (US)

(73) Assignee: Brazeway, Inc., Adrian, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/732,141

(22) Filed: Dec. 7, 2000

(65) Prior Publication Data

US 2002/0070012 A1 Jun. 13, 2002

(51) Int. Cl.[7] ..... B21C 23/00

(52) U.S. Cl. ..... 72/256; 72/370.24; 72/370.25; 29/890.053; 165/177

(58) Field of Search ..... 72/256, 269, 367.1, 72/370.23, 370.24, 370.25; 29/890.052, 890.053; 165/172, 173, 175, 176, 177

(56) References Cited

U.S. PATENT DOCUMENTS

| | | | | |
|---|---|---|---|---|
| 1,793,244 A | | 2/1931 | Phelps | |
| 1,820,227 A | | 8/1931 | Keenan, Jr. | |
| 2,067,076 A | | 1/1937 | Craighead | |
| 3,645,330 A | | 2/1972 | Albright et al. | |
| 4,071,934 A | | 2/1978 | Zolman et al. | 15/26 |
| 4,203,311 A | * | 5/1980 | O'Connor et al. | 72/256 |
| 4,294,625 A | | 10/1981 | Hyatt et al. | |
| 4,512,069 A | * | 4/1985 | Hagemeister | 72/256 |
| 4,560,625 A | | 12/1985 | Kaifu et al. | |
| 4,715,431 A | | 12/1987 | Schwarz et al. | |
| 4,716,959 A | | 1/1988 | Aoki | |
| 4,778,004 A | | 10/1988 | Paulman et al. | |
| 4,789,027 A | | 12/1988 | Diethelm | |
| 4,869,316 A | | 9/1989 | Yoshida et al. | |

(List continued on next page.)

FOREIGN PATENT DOCUMENTS

| | | | | |
|---|---|---|---|---|
| JP | 49-114145 | | 10/1974 | |
| JP | 57-66389 | | 10/1980 | |
| JP | 60-205192 | | 10/1985 | |
| JP | 63-108914 | * | 5/1988 | 72/256 |
| JP | 2-192818 | * | 7/1990 | 72/256 |
| JP | 40-7041894 A | | 2/1995 | |

*Primary Examiner*—Ed Tolan
(74) *Attorney, Agent, or Firm*—Harness, Dickey & Pierce, P.L.C.

(57) ABSTRACT

This invention is a process for making micro-multiport tubing for use in heat exchangers. The tubing is a flat body with a row of side-by-side passageways, which are separated by upright webs. Processing of this tubing involves extrusion, a straightening and cutting operation, a rolling step to reduce the thickness of the flat body and to obtain ultra small voids, assembly and furnace brazing of the heat exchanger. This invention improves the grain size of the metal in the tubing and also improves the metallurgical strength of the tubing. There is at least 10 percent change in material thickness. The strain is concentrated at the center of the web and results in at least enough cold work to produce fine recrystallized grains during the brazing thermal cycle. The amount of grain growth is controlled and the improvement in the metallurgical strength is achieved.

12 Claims, 1 Drawing Sheet

U.S. PATENT DOCUMENTS 4,881,311 A 11/1989 Paulman et al.
4,901,908 A 2/1990 Negura et al. ..... 1/12
4,984,626 A 1/1991 Esformes et al.
4,991,647 A 2/1991 Kawabe et al.
5,009,263 A 4/1991 Seshimo et al.
5,036,909 A 8/1991 Whitehead et al.
5,054,549 A 10/1991 Nakaguro
5,058,266 A 10/1991 Knoll ..... 29/890.049
5,183,105 A 2/1993 Adams
5,186,250 A 2/1993 Ouchi et al.
5,240,067 A 8/1993 Hatch
5,251,692 A 10/1993 Haussmann ..... 165/152
5,351,750 A 10/1994 Garcia
5,353,639 A 10/1994 Brookins et al.
5,509,469 A 4/1996 Obosu
5,518,070 A 5/1996 Kato
5,535,820 A 7/1996 Beagle et al.
5,660,230 A 8/1997 Obsosu et al.
5,927,393 A 7/1999 Richter et al.
5,988,967 A 11/1999 Jones ..... 411/489
6,125,925 A 10/2000 Obosu et al.
6,155,339 A * 12/2000 Grapengater ..... 165/173
6,159,315 A 12/2000 Haszler et al.
6,192,978 B1 * 2/2001 Guzowski et al. ..... 72/256

* cited by examiner

MULTIVOID HEAT EXCHANGER TUBING WITH ULTRA SMALL VOIDS AND METHOD FOR MAKING THE TUBING

BACKGROUND AND SUMMARY OF INVENTION

Contemporary automotive air conditioning systems typically use parallel flow condensers, other heat exchangers, and gas coolers which are used on $CO_2$ systems that are fabricated with extruded tubing. This tubing, which is referred to as micro-multiport (MMP) tubing, is generally made from 1XXX or 3XXX Al alloys. The tubing is a flat body with a row of side-by-side passageways, which are separated by upright webs. Processing of this tubing involves extrusion, a straightening, sizing and cutting operation, assembly and furnace brazing. Brazing is generally done at 600°–605° C. (about 94% of the melting temperature of pure Al). The typical tube straightening and sizing operation imposes a small amount of cold work, in the critical range, which causes extremely coarse grains to grow during the brazing process.

Material handling involves winding the tube on coils and transferring these coils to a straightening and cutting operation. It is during this operation that the final width, thickness and length dimensions of the cut pieces are achieved. The cut pieces are then assembled into a condenser core with fin stock and headers that are clad with a brazing alloy. This assembly is brazed at 600 to 605° C.

The production of automotive condensers from aluminum MMP tubing involves an interaction of the tubings and process conditions that can result in undesirable material properties. The combination of a small amount of cold work and the high brazing temperature that must be imposed on the tube cause extremely large grains to form, and this has a significant effect on mechanical properties.

Small amounts of cold work are imposed on the tube during straightening/sizing and material handling. This small amount of deformation can lead to a phenomenon in which very large grains in the aluminum are formed during the brazing process. If a critical amount of cold work is imposed on the tube prior to brazing, then extremely large grains will form after recrystallization. The critical amount of cold work is defined as the amount of strain just necessary to initiate recrystallization. Since few nuclei are formed in the metal, the growth of relatively few recrystallized grains is allowed to proceed with minimum resistance. Conversely, as the amount of cold work increases, more nuclei are produced and the recrystallized grain size decreases.

This invention improves the grain size and the metallurgical strength of the tube by cold working the tubes and controlling the grain size. A multivoid heat exchanger tube is extruded from aluminum alloy billet. Tube dimensions, particularly the size of internal voids are limited by how small extrusion dies and tooling can be manufactured, specifically the mandrel which forms these voids. To achieve ultra small voids in the tube that cannot be achieved with extrusion alone, the tube is put through a rolling process which allows extremely small voids of varying shapes to be formed in the tube. Port shapes that can be formed approximate circles, ellipses, squares and rectangles. The internal walls (sometimes called "web walls") can be extruded with a concave shape to achieve the desired shape after extrusion. Rolling thickness reduces the tubes to achieve the desired dimensions above ten (10) percent. The reduction in thickness of the tube and the strain resulting from the cold working imparts the desired strength in the tube.

In FIG. 3, as shown, a multivoid tube prior to cold working has a thickness of a 1.33 mm and port diameter of approximately 0.75 mm.

In FIG. 2, the rolled tube now has a thickness of 0.94 mm and an average port diameter of approximately 0.35 mm.

Accordingly, this invention provides an improved process for enhancing the metallurgical strength of a multivoid tube for use in a heat exchanger. The invention provides a multivoid tube which includes webs between the ports that are configured such that when there is at least a ten percent change in material thickness, the strain from cold working of the tube is concentrated at the center of the webs to improve the strength of the tubing and maintain the desirable small grain growth in the metal tube.

Further objects, features and advantages will become apparent from a consideration of the following description and the appended claims when taken in connection with the accompanying drawings.

DETAILED DESCRIPTION OF THE PREFERRED EMBODIMENT OF THE INVENTION

Figure 1:
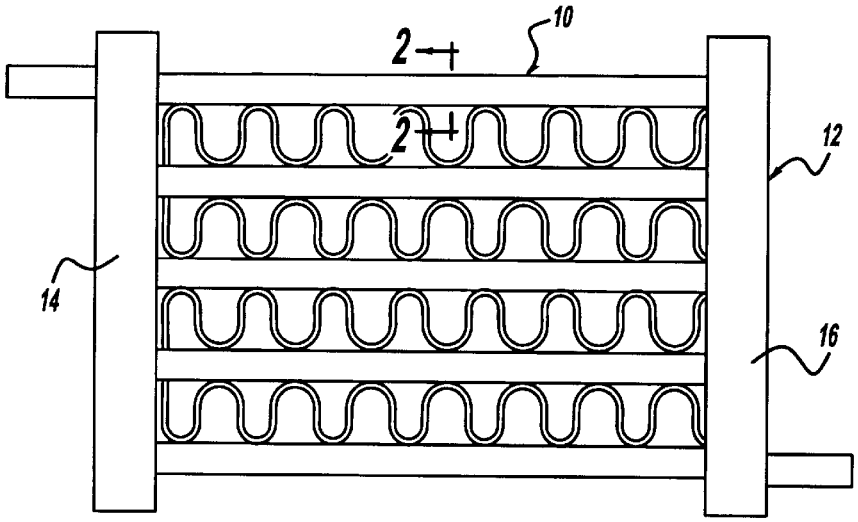
FIG. 1 shows a heat exchanger utilizing the multiport tubing of this invention.
Figure 3:
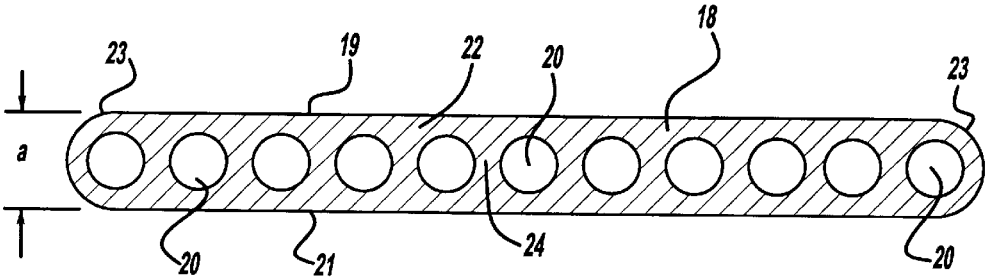
FIG. 3 is a fragmentary cross-sectional view of the tubing shown in FIG. 2, in the form before the tubing was subjected to cold working.

With reference to the drawing, the tubing of this invention, indicated at 10 in FIG. 1, is shown in a heat exchanger 12 with frame members 14 and 16. The tubing 10 consists of a metal body 18, which is an aluminum alloy. The body 18 is made by extrusion and the shape of the extruded body 18 is as shown in FIG. 3. The body is generally rectangular in shape having opposite faces 19 and 21 and outwardly facing rounded edges 23. A number of ports or passages 20 are arranged side-by-side between the edges 23. All of the ports 20 are of the same size and shape except for the end ports which vary only on one side.

Figure 2:
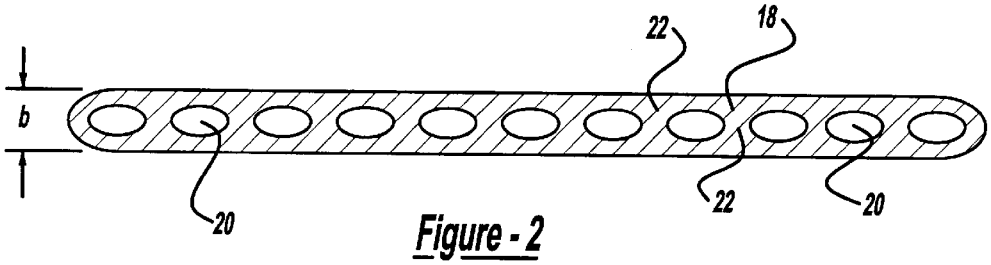
FIG. 2 is an enlarged cross-sectional view of the tubing of this invention as seen from the line 2—2 in FIG. 1.

As shown in FIG. 3, the ports 20 are defined by internal walls or webs 22, which extend in upright positions with a reduced thickness section 24 in substantially the center of the web 22. In the body 18 illustrated in FIG. 2, there are eleven ports 20 in side-by-side relation and each one is defined by at least one web 22. The tube 18 is of a flattened configuration having a width that is at least three times as long as the height "a" of the body 18. In actual practice, the body 18 can be 6 mm to 50 mm wide, 1 mm to 7 mm high and part of a long extrusion, which is coiled for subsequent cutting into strips and straightening.

It is during the coiling, straightening and cutting operations that the final width, thickness "b" and length dimensions of the cut pieces are achieved.

These pieces are then assembled into the frame 12 and subjected to brazing with a brazing alloy at temperatures between 600° and 605° C. In this invention, the body 18 is subjected to additional cold working, such as rolling the body in a rolling mill (not shown) that will compress the body 18. Also, this additional cold working of the body 18 functions to control the grain size of the metal. In other words, the smaller grains are retained or nucleation takes place and additional smaller grains are achieved.

Cold working is primarily concentrated in the internal walls (web walls). By reducing the thickness of the tube by more than 10% (actually it may be more than 25%) enough cold work can be an amount that will result in a smaller post braze grain size, and hence higher strength.

From the above description, it is seen that this invention enhances the metallurgical strength of the tubing 10 so that the life of the heat exchanger 12 is extended and the tubing 10 will function for a longer time without maintenance.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A multi-port tube for use in a heat exchanger, said tube comprising an extruded metal body made at least partially from aluminum, said body having an extensive width and a thickness less than one third of its width, means providing side-by-side similar passages in said body extending in a row from side-to-side of said body, webs in said body between each pair of said passages, each web being of an irregular shape and having a central portion with a reduced thickness; and said body being subjected to successive cold working to a level wherein said thickness of the body is reduced by at least ten (10) percent to achieve extra small passages and small metallurgical grains in the body is achieved.

2. A process for improving the metallurgical strength of a multi-port tube for use in a heat exchanger, said tube comprising an extruded metal body made at least partly from aluminum, said body having an extensive width and a thickness less than one third of this width, means providing a number of similar passages in said body extending in a row from side-to-side of said body, webs in said body between each said passage having a central portion with a reduced thickness, subjecting the body to cold working to a level where the passages are reduced in size and the thickness of the body is reduced by more than 10%, and a grain structure in the body is enhanced by increasing the percentage of small grains after brazing.

3. The process according to claim 2 wherein said cold working of said tube is accomplished by rolling the tube to reduce the thickness of the tube.

4. The process according to claim 3 wherein said tube is reduced in thickness in the range of 10 to 50 percent.

5. A method of forming a multi-port tube for use in a heat exchanger, said method comprising:

extruding a tubing member having a plurality of internal ports longitudinally extending therein, each of the plurality of internal ports being separated by a web section, said web section having a central portion with a reduced thickness, said tubing member having a first thickness; and cold working said tubing member to reduce the internal volume of each of said plurality of internal ports and further to generally concentrate the structural strain of said tubing member at said web sections, said tubing member having a second thickness that is less than said first thickness following said cold working.

6. The method according to claim 5 wherein said step of cold working said tubing member includes cold rolling.

7. The method according to claim 5 wherein said second thickness is less than or equal to about 90% of said first thickness.

8. The method according to claim 5 wherein each of said plurality of internal ports has a port diameter less than about 0.50 mm.

9. A multi-port tube produced by the process comprising:

extruding a tubing member having a plurality of internal ports longitudinally extending therein, each of the plurality of internal ports being separated by a web section, said web section having a central portion with a reduced thickness, said tubing member having a first thickness; and cold working said tubing member to reduce the internal volume of each of said plurality of internal ports and further to generally concentrate the structural strain of said tubing member at said web sections, said tubing member having a second thickness that is less than said first thickness following said cold working.

10. A multi-port tube according to claim 9 wherein said step of cold working said tubing member includes cold rolling.

11. The multi-port tube according to claim 9 wherein said second thickness is less than or equal to about 90% of said first thickness.

12. The multi-port tube according to claim 9 wherein each of said plurality of internal ports has a port diameter less than about 0.50 mm.

* * * * *